United States Patent [19]

McKinney

[11] 4,043,490

[45] Aug. 23, 1977

[54] VOLUMETRIC FILLING SYSTEM APPARATUS

[76] Inventor: Harold D. McKinney, Rte. 4, Box 404, Pine Bluff, Ark. 71601

[21] Appl. No.: 567,047

[22] Filed: Apr. 10, 1975

[51] Int. Cl.[2] ..... G01F 11/28

[52] U.S. Cl. ..... 222/442; 222/438

[58] Field of Search ..... 141/1-12, 141/285-311, 392, 59, 39-46, 18; 222/1, 437, 438, 442, 479

[56] References Cited

U.S. PATENT DOCUMENTS

| | | | |
|---|---|---|---|
| 362,393 | 5/1887 | Muller | 222/437 |
| 1,763,971 | 6/1930 | Kantor et al. | 222/437 |
| 1,893,391 | 1/1933 | Berry | 222/437 |
| 2,912,830 | 11/1959 | Coldren et al. | 141/2 |

*Primary Examiner*—Houston S. Bell, Jr.

*Attorney, Agent, or Firm*—Nathan Edelberg; Robert W. Church

[57] ABSTRACT

A new filling apparatus for liquids and slurries.

8 Claims, 10 Drawing Figures

VOLUMETRIC FILLING SYSTEM APPARATUS

The invention described herein may be manufactured and used by or for the Government for governmental purposes without the payment of any royalties thereon or therefor.

BACKGROUND OF THE INVENTION

The present invention relates generally to the field of munition payload filling apparatus and to other liquid and quasi-liquid filling apparatus where precise quantities are dispensed.

Persons working in the munitions-making field are now and have been plagued with a multitude of problems. Aside from the hazards of making lethal munition materials, per se, problems of assembling the various components to make up a munition which is economically made and possesses the optimum in reliability and safety characteristics are ever present. My invention cures one of those problem areas. It deals with a new, unobvious and reliable apparatus which aids in the filling of munition canisters and housings with payload materials.

In the past, processes of filling liquids and quasi-liquids such as acids, chemicals, solutions, slurries, etc., in containers have had shortcomings. These shortcomings have been compounded when volatile, combustible, and flammable materials have been placed in containers. The more complex the equipment, and involved the process is, the more prone to breakdown the system becomes. Any malfunction in a process involving incendiaries, flame agents, explosives, and toxic can create irreparable harm and injury to both person and property.

Numerous methods of filling containers and canisters with liquids are known and are in use.

The gravity or weight method is used. Here the material is progressively weighed in either the container per se or an ancillary container until the proper amount is had. Thereat the filling is stopped. Various scales have been used including electronics, lever, etc., types coupled with or without automatic dumps. However, in the potentially dangerous fill material area wherein corrosion, and erosion of the filling apparatus has been common place, this technique has been found unworkable.

Dip filling has been long known and in fact would appear to stem from caveman times. Here the container to be filled, or, the filler scoop is dipped or submerged into the filling material to a specific depth to thereby fill it and then it is removed therefrom. A good example is the water dipper. It was conventionally used in years gone by, i,e., before the advent of indoor plumbing.

Gravity or pressure-time fill has also been a common use technique. Here, the liquid or quasi-liquid, is flowed into the container or filler mechanism after empirical and/or calculated data indicates a certain amount of material has passed through the outlet. Then a valve, for example, can control flow.

Of the above cited well-known process of filling containers and canisters, all have drawbacks and all do not repetitively provide the same amount of fill in each container. Especially, when used in the acids, chemicals, solutions, slurries and petroleum products area. Corrosion and erosion of the filling apparatus presents numerous problems. The fewer moving parts and automated steps involved diminish the breakdown time; i.e., in the dip method, for example, chain and gear driven conveyors where toxic material is used cause numerous problems of wear, lubrication, deterioration and disintegration to occur. In the pump and gravity methods by weight measure techniques the measure apparatus is of constant concern. In the time method of fill techniques, the apparatus plus viscosity and velocity problems create constant deviations. In all of the above cases isolated atmosphere filling compounds existing problems.

My invention was conceived and reduced to practice to solve the above described problems and to satisfy the long-felt need of providing constant, reliable and safe fills in this difficult to work with area of acids, toxics, chemicals, solutions, munition payloads, slurries and petroleum products where fire and blasts due to explosions and implosions are common place.

Briefly, my invention is a new reliable and safe volumetric cylinder used in my process of filling canisters and containers of varying sizes and shapes with the same volume of liquid or quasi-liquid natural. My process is claimed in copening application Ser. No. 559,859 filed 19 Mar. 1975. It works on the differential pressure principle. That is, my new volumetric cylinder or container is accurately and repeditively filled with the liquid or quasi-liquid fill material in constant amounts by using an overflow or vent tube to equalize the pressure. More specifically, a fill line from a supply source is used and a parallel return line is used. The fill material flows to my new and unobvious volumetric cylinder from the source until an equal pressure minus friction is had. Once this occurs no more fill material will flow therefrom. Hence, a static condition exists so that repetitively this same amount of fill material will always come into the cylinder if the same conditions exist. That is, if the cycle be repeated the cylinder is filled with the same amount of fill material.

My invention provides for exacting and uniform amounts of liquid or quasi-liquid amounts to be deposited in canisters and containers. Further, and most importantly, by the use of volumetric cyclinder in my process, less moving parts are used so that hard to work with acids, chemicals, solutions, mixtures, slurries, etc., of diverse materials can be controllably placed and deposited in containers.

A principal object of my invention is to provide a container for uniformly measuring and transferring materials to containers or packages;

Another object of my invention is to provide a cylinder for measuring and transferring materials in fluid form to containers or packages;

A further object of my invention is to provide a cylinder for measuring and transferring materials in liquid and quasi-liquid form to containers or packages;

A still further object of my invention is to provide a cylinder for measuring and transferring materials in the form of explosives and flammables and other hazardous materials in liquid and quasi-liquid form into containers and packages in uniform quantities.

Other objects will become more apparent after considering the following description of the invention in conjunction with the accompanying drawings.

DESCRIPTION OF MY INVENTION

Figure 4:
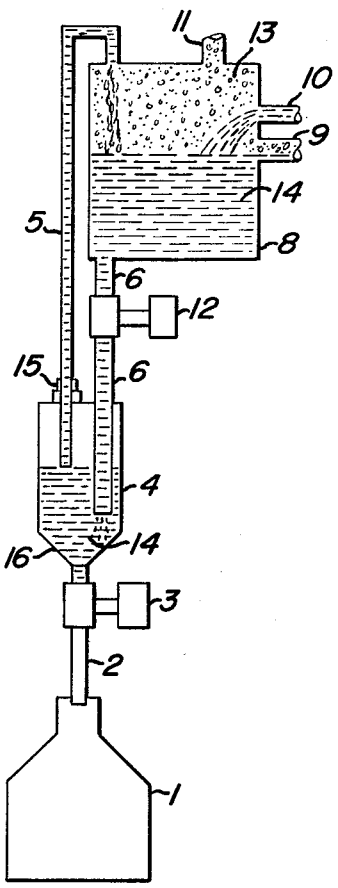
FIGS. 2–8 depict the various stages of my filling process using the above simplified apparatus to explain the background and use of my new cylinder.
Figure 3:
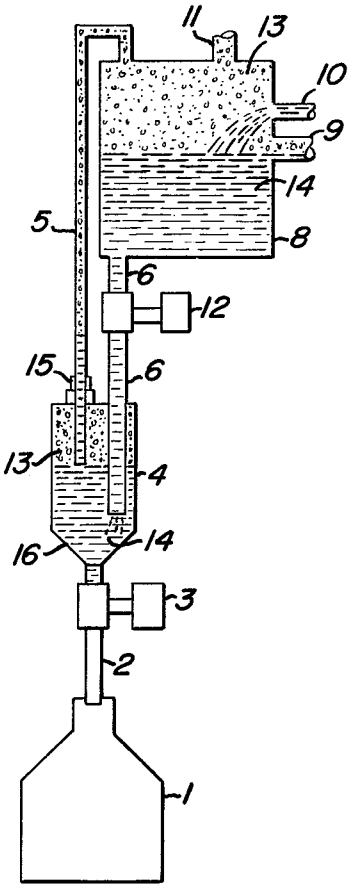
Figure 2:
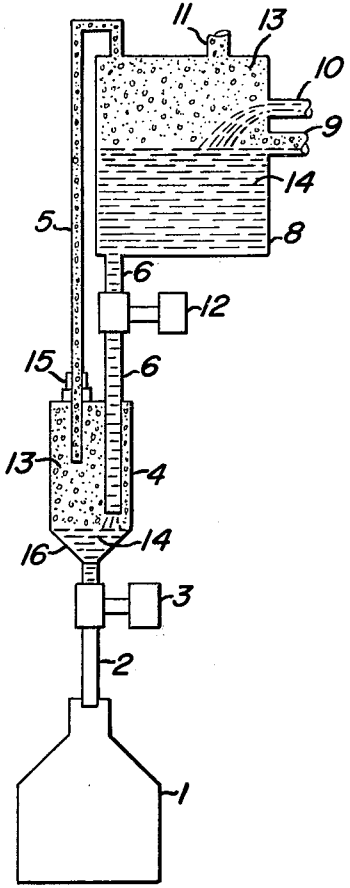
Figure 1:
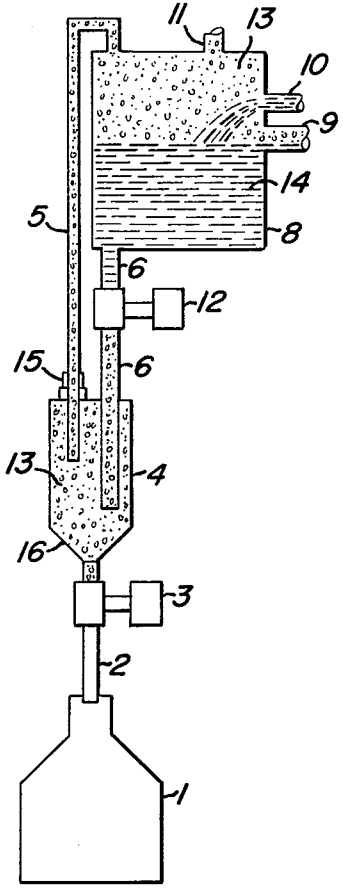
FIG. 1 shows the simplified form of apparatus depicting my process before it has commenced.

Referring to FIG. 1, numeral 1 is a canister, package or container to be filled. Numeral 14 is fill material in flowable form; i.e., either liquid, or slurry form preferably. However, it is understood that granulated or certain powder material would work as well. My process can be used for anything from milk to white phosphorous material in liquid form. And it can be used with varying degrees of viscosity. Numeral 4 is my volumetric cylinder that assures constant, reliable and repeditive proformance of my process. Herein is where the fill material 4 is quantity measured. Element 3 is the lower volumetric cylinder control valve which controls the fill material flow from the cylinder 4 by way of connecting pipe 2. Valve 3 can be mechanically actuated in any conventional manner. That is, electronical, by hand or mechanical remote control linkages are conventional modes therefor. The only critical thing is, that same should remain closed until cylinder 4 contains the proper amount of fill material 14. Supply tank 8 shown upwardmost, contains fill material 14. Since this is a gravity fill method it is critical that the fill material 14 have a substantially constant head. That is, heighth. Hence, return or overflow pipe 9 connected to the fill material main supply, not shown, functions to enable the material 14 to be always at approximately the same level otherwise it will flow back into the main supply thereby. To assure that supply tank 8 is always provided with the constant head (here determined by the lowermost portion of pipe 9) pipe 10 is the means by which material 14 is at the constant head level especially when fill material 14 is flowed into volumetric cylinder 4. To control the flow of fill material 14 from supply tank 8 to volumetric cylinder 4, I use valve 12. It can be of any variety and made to work in numerous ways; i.e., solenoid (electronic), mechanical linkage, know, etc. Valve 12 can so also be called a dump valve. Pipe 6, to which valve 12 is affixed, serves to transfer the liquid, or quasi-liquid fill material from tank 8 to volumetric cylinder 4. It can be adjustable; i.e., in depth of penetration into volumetric cylinder 4. This alternative and the purpose thereof can be explained later. Leftmost and adjustably extending at 15 from volumetric cylinder 4 to the upper portion of tank 8 is vent or return vent 5 through which surplussage fill material 14 can flow if need be (to be explained later). Since my process can be devoid of atmospheric influences; i.e., atmosphere air or gas pressure and function in an inert or non-atmospheric environment numeral 13 represents such a medium. Since constant pressure is most critical to my process, I find it necessary to have vent means in supply tank 14 so that my process functions at its optimum efficiency and that reoccurring, consistent and repeditive results are had. This comes about by having a constant bleed off of fluid gas 13 pressure at 11 or by having a relief or control valve (not shown) controlling pressure for either inward or outward fluid or gas 13 flow. Throughout my description all numerals of the various figures will be the same.

Figure 8:
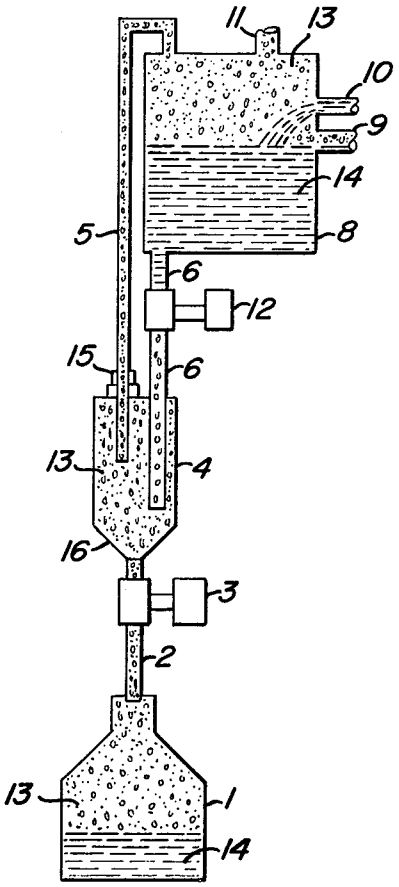
Figure 9:
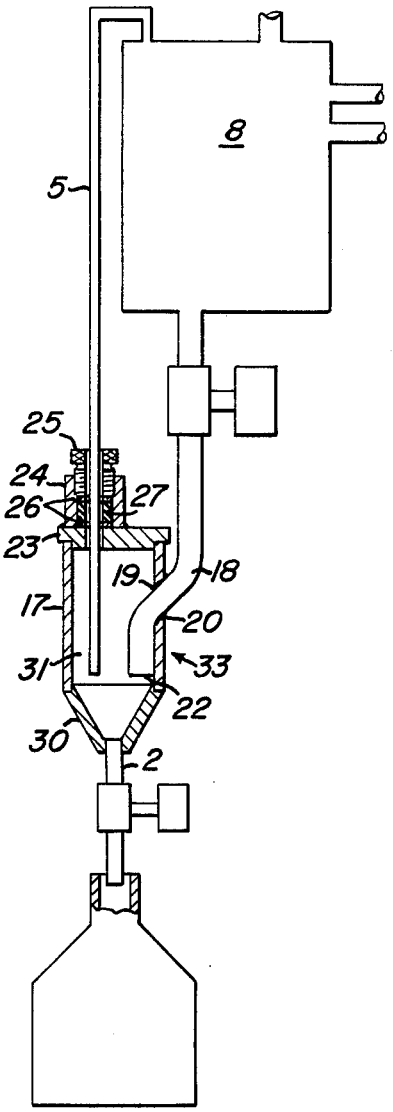
FIG. 9 depicts my new cylinder of another design in a working system.

Referring to FIG. 9, I show my invention volumetric cylinder 33. It is much the same in appearance to that of FIGS. 1–8 excepting inlet pipe or tube 18 has an offset configuration so as to render more useable volume in volumetric cylinder 33. Here tube 18 is threaded through aperture 19 provided in cylinder body 17 and secured therein by way of weld 20 which is a bead run entirely around pipe 18. Pipe 18 extends to the lowermost portion of cylinder body 17 to enable maximum load adjustment as aforementioned. All elements designated in FIGS. 1–8 and not designated otherwise in FIG. 9 apply in FIG. 9. The apparatus combination and its process functions the same as will be described below.

Figure 10:
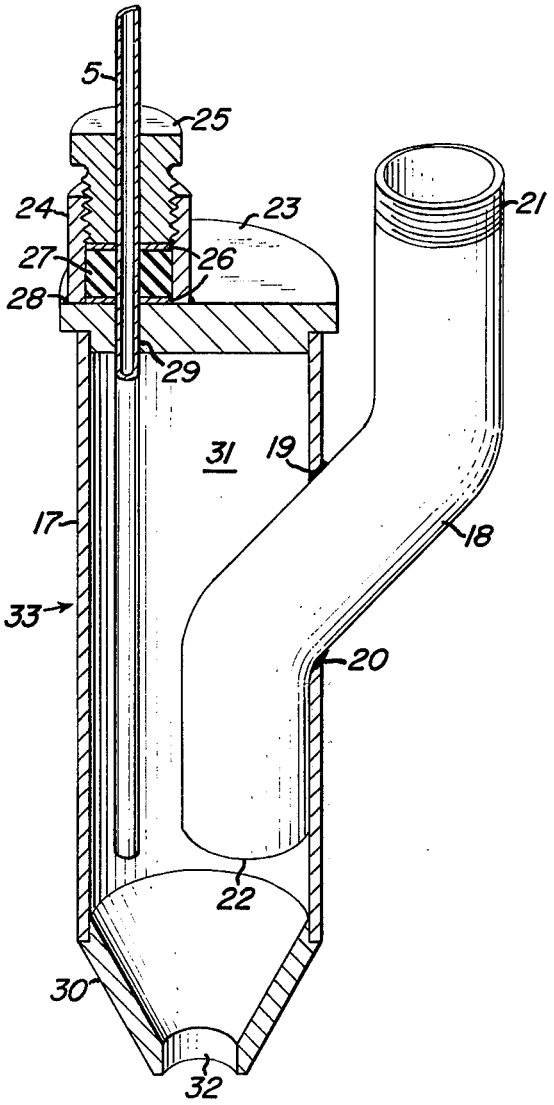
FIG. 10 depicts my new cylinder apparatus.

Referring to FIG. 10, I herein define my new and unobvious volumetric cylinder 33 invention. This is an enlarged view of that set out in FIG. 9. Body 17, cap 23, and drain portion 30 and all associated parts make up cylinder 33. Here inlet pipe 18 has its upper extremity 21 threaded and readied for connection to the system by a coupling not shown. Lower portion 22 of pipe 18 should extend to the depth of minimum possible capacity of body 17. Hence, if it is desired to have large adjustment; i.e., down to minimum quantities, pipe end portion 22 could be enlarged and dropped closer to the bottom portion 30 of cylinder 4. Closing the top portion of cylinder 4 is cover or cap 23 which sealably affixed to cylinder by force fit metal to metal engagement. However, it is within the purview of my invention to use either hardenable resinous material interposed between cap 23 and body 17, or to thread the mating parts with gasket material interposed or to use cap screws or bolts threadably engaging portions of body 17, or to use some spring or screw actuatable clamp mechanism with a gasket interposed. So also, it is understood, if desired, that cap 23 could be molded of plastic like material or cast of metal material and made integral with and a part of body 17 without departing from my inventive concept. Pipe 18, or a substitute therefor, could be extended through cap 23 or the bottom thereof without departing from my invention concept. In case of placing feed pipe or tube 18 through cap 23, it would, of course, take different form; i.e., it could be straight, for example. Extending through cap 23 in a sealed manner is return vent tube 5 which functions as recited above dealing with FIGS. 1–8, for example. It is adjustable to extend deeper into (downward) body 17 or to be withdrawn therefrom. Boss 24 extending upwardly from cap 23 houses the adjustment means which both seals tube 5 to cap 23 and snuggly holds same, from vertical movement inasmuch as the depth tube 5 extends therein is critical to the volume of the apparatus volumetric cylinder. Boss 24 is internally threaded to received knurled screw 25. Beneath screw 25 and sandwiched between metal washers 26 is resilient seal member 27 of gasket or elastic material such rubber, paper, fiber, nylon, or Teflon. It is noted that washers 26 may also be of non-metals as well. They function to provide uniform pressure on seal or packing member 27. Loosening of screw 25 releases pressure on vent tube 5 so that vent tube 5 can be raised or lowered into cavity 31. Boss 24 can be a welded pipe, as shown, wherein weld bead 28 secures same to cap 23. Also, it can be, if desired, cast or molded integral part of cap 23. Aperture 29 not before mentioned, provides for access of the interior of cylinder 33 by tube 5. It may be of any diameter. Preferably slightly larger than the outside diameter of tube 5. In all instances, it must not be larger than lower washer 26 to keep it from being forced into cylinder 33 fill cavity 31. Numeral 31 designates the volume defined by cylinder 33. Closing off the lower portion of cylinder 33 is bottom or drain portion 30. Drain 30 is sealed to body 17 here by a tolerance fit.

However, any convenient means of sealing and securing drain 30 to body 17 is perceived. Those expedients set out above dealing with cap 23 are hereby incorporated. Drain 30 could also be made of metal or plastic material and cast or molded integrally with body 17 without departing from my inventive concept. Orifice 32 is adapted to receive outlet pipe 2, for example. It is of a size to enable a tolerance fit between drain 30 and the outside diameter of pipe 2 to create a seal. However, it is understood pipe 2 could be threaded and attached thereby. So also, welding, brazing and resinous bonding techniques could be used to secure pipe 2 to element 30.

My invention volumetric cylinder 33 of FIG. 10 is made of stainless steel excepting for seal member 27. However, it is understood other metals and non-metals could make up all the components of my invention without departing from the spirit thereof. That is, copper, aluminum, and alloys thereof and also numerous other metals, as well as epoxies and all types of thermoplastic and thermosetting as well as catalized resins are perceived to be usable.

Pipe 18 is 1½ stainless steel "sch 40" pipes bent with reverse elbows to achieve the offset S-shape. Element 30 is machined stainless steel material having a wall thickness of one-half inch. Aperture 32 can be ¾ pipe diameter and of appropriate bore size therefor. Body 17 is of 3 inch diameter sch 40 pipe about 9 or more inches long. Cap 23 is stainless steel stock ¾ inches thick and reduced to tolerance fit body 17. Aperture 19 is of a diameter to allow insertion of pipe 18 and is then welded closed at 20. Boss 24 is 2 inch diameter stock with the washer and seal receiving bore being 1¼ inches in diameter or less.

Elements 26 and 27 are of an outside diameter to coincide with the inside diameter of the boss 24. Knurl screw 25 has a 1½ inch pipe thread to match that of boss 24. Aperture 29 should be large enough to slidably receive return vent tube 5. Here return vent tube 5 is 3/16 inch inside diameter tubing of stainless steel. The aperture in seal 27 and those of washers 26 should be to enable relative movement there within with the outside surface of tube 5.

PROCESS OF OPERATION

Referring first to FIG. 1, I now will describe my new and unobvious process of filling, (including diverse sizes and shapes) containers with like amounts of fill material 14. Container, canister, or receptacle 1 is relatively associated with the outlet of pipe 2 so that it is ready to receive material 14. Note, at this point valve 12 is closed, return tube 5 is secured and at a constant heighth, and a head of material 14 is had in supply tank 8. Here also the main supply pipe 10 is assuring us that tank 8 is at desired head and that input therefrom is going out overflow pipe 9. Valve 3 is closed. First, dump valve 12 is opened. This creates a fluid displacement in volumetric cylinder 4. That is, as fill material 14 flows from tank 8 through pipe 6 past valve 12 into cylinder 4 the air or inert fluid 13 in volumetric cylinder 4 is forced through return vent tube 5 back to tank 8 to thereby form a blanket 13 over fill material 14 in tank 5.

Referring to FIGS. 2–5, fill material 14 continues to fill volumetric cylinder 4 as shown. This phenomenon continues until the fill material 14 finds its own level; i.e., that of tank 8 theoretically (see FIG. 5). However, this will not occur, exactly, because of friction in tube 5. So also, because of that which occurs in FIG. 4. Here, in line with Newton's law, "matter once in motion continues in motion unless acted upon by external force." That is, due to the speed of fill, etc., a slight over shot will occur unless my process is practiced slowly. Once the over-shot flow stops, no more filling of the volumetric material occurs. That is, unless the system is modified or altered a static condition exists.

Figure 7:
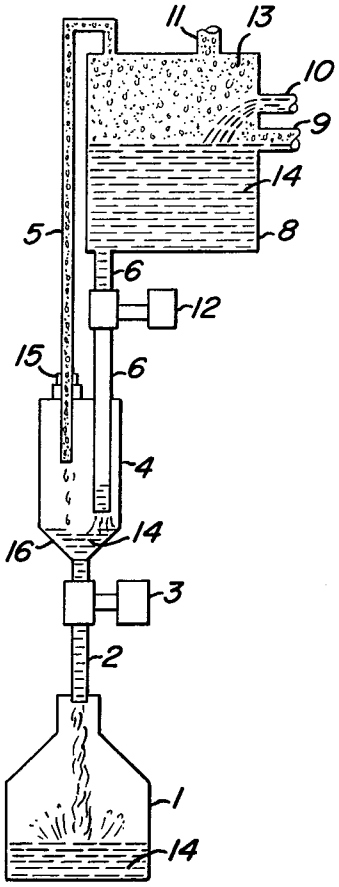
Figure 6:
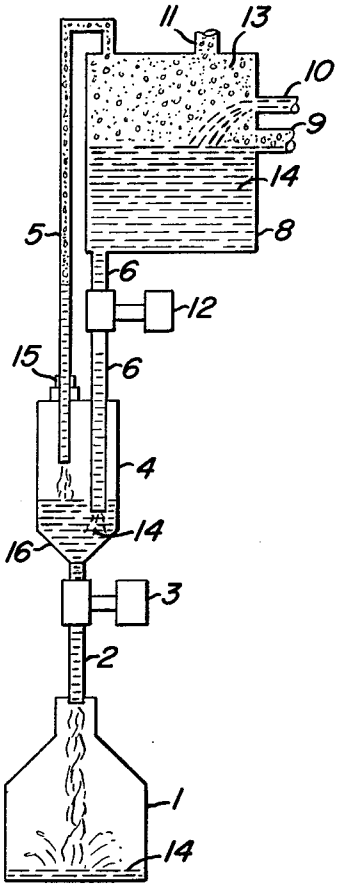
Figure 5:
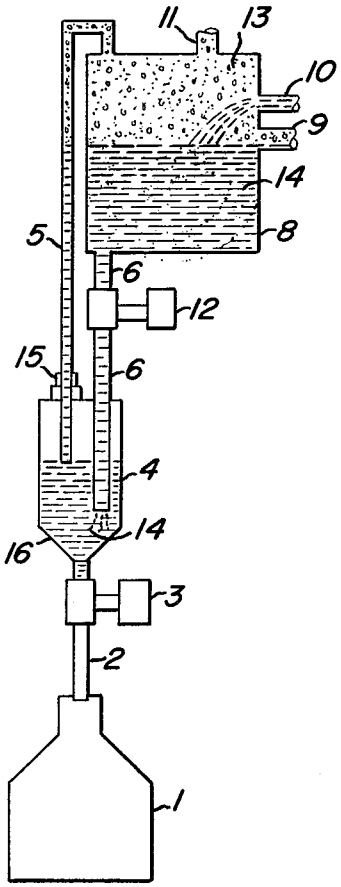

Referring to FIGS. 6–8 transfer of a prescribed quantity of material 14 from volumetric cylinder 4 to container 1 can be had. First, valve 12 should be closed. Then valve 3 can be opened. This will then allow all material 14 below valve 12, that in cylinder 4, and that in return tube 5 to flow through pipe 2 past valve 3 into container 1. Once all flow has stopped, valve 3 is closed. Container 1 is now filled. The reverse has occurred now. The fluid 13 replaced the liquid or quasi-liquid 14 as first shown in FIG. 6. Here note how the liquid level or the liquid gas interface in return vent tube 5 has dropped in FIG. 6. It has been replaced by fluid 13 as is shown in FIG. 7. Reference to FIG. 8 shows that the transfer into container 1 is complete and that fluid 13 has completely displaced that of the fill material 14. Next, valve 3 is closed to prevent further escape of fluid or gas 13 from cylinder 4. After removing container 1 relatively from beneath the pipe 2 an empty container can be substituted therefor and the process repeated.

The operation of the volumetric cylinder 33 of FIGS. 9 and 10 is the same as that above described.

Adjustment of the quantity of material measured and ready for transfer is easily had. My unique and unobvious process is complimented by a simple adjustment technique. Here, merely by raising or lowering return vent tube 5 within cylinder 4 or 33 the amount of fill material is quantitatively varied. This is best shown by viewing FIG. 5 or FIG. 10. If return vent tube 5 is raised or withdrawn a distance from its present position, then the pressure head differential will be modified until a static condition again exists. This will not occur unless valve 12 be open, of course. Cylinder 4 or 33 will then be filled to a greater heighth; i.e., until the liquid or quasi-liquid 14 level in return vent tube 5 is equal to the head in tank 8 minus friction loss and deviation due to volumetric compression of the fluid 13 above the fill material 14. If it is desired to reduce the amount to be dispensed from the cylinder 4 or 33 then the antithesis must be done. That is, return vent tube 5 must be caused to move downwardly farther into cylinder 4 or 33. The result is that the amount of fill material in cylinder 4 will be relatively reduced.

The most important component to make by process workable is of course my unique volumetric cylinder 4 or 33 which assures one of reliable, repetitive, and consistent fills. It can be any size and of any general shape. For most efficient results, of course, it should have a lower portion adaptable for ready emptying; i.e., with a declining surface 16, more vividly depicted in FIG. 10, for example. It is critical that it be a substantially sealed unit; i.e., excepting for orifice means for the outlet as represented by pipe 2, the vent tube return 5 orifice, and supply pipe 6 or 18 access means. So also, it should be of such construction so as to hold the fill material and hold the pressures of the fluid or gas medium so as to not be distorted. Stainless steel of the type used on commercial machinery has been used with success.

The distance pipe 6 extends into cylinder, 4 or 33 is dependent upon the desired minimum capacity level of the cylinder. That is, it should be nearest the bottom of the cylinder if vast adjustment is desired because, to properly operate pipe 6 must always be lower than the lowest most point of return vent tube 5.

Defined in another way my process, as defined and claimed in Ser. No. 559,859 filed 19 Mar. 1975, controllably regulates and deposites a quantity of liquid or slurry and/or liquid-like material 14 in a measuring means 4 or 33 from a supply means 8. The amount of material 14 dispensed with my process is always the same amount, that is, unless I desire to modify the amount allowed to flow into volumetric cylinder 4 or 33. My process is closed loop make up essentially of supply means 8 with material 14 gravity feeding receiver or dispenser 4 or 33 by way of feed line 6 and return vent line 5. The length of the loop is modified within receiver 4 or 33 by adjusting the depth of return line 5 relative to feed line 6 which must be always lower or at least equal in depth to line 5. Essentially, my process is the use of two different or dual fluids; i.e., 13 and 14. One must be heavier. Here, as before described, I choose to make material 14 more viscose. Gravity causes the heavy fluid 14 to be conducted into receivers 4 or 33 by way of feed line 6 and thereby displace lighter immiscible fluid 13 therefrom. Any type material 13 can be used; i.e., from air to any other gases. Also, any liquid or slurry 14 can be used as that which is to be dispensed. Constant flow of the dispensed fluid 14 into supply tank 8 of course makes for more accurate cyclic dumps.

A machine to practice my process can take diverse shapes. The real criticalities lie in the requirements that tank 8 must be elevated above volumetric cylinder 4 or 33 for gravity operation; that a feed line 6 or 18 extends as far as possible to the bottom of cylinder 4 or 33; and a vent return tube 5 must be affixed in substantially the way depicted in the drawings. Materials to make up the machine may be varied. Glass to stainless steel depending upon the dictates of the fill material would be acceptable. Also, the fluid 13 may consist of anything lighter than the fill material and immiscible with it. Also, cylinder 4 must be sealed and elements 5 and 6 or 18 sealed as well.

For the practice of my process, the following components were used to place white phosphorus in ammunition canisters. Referring to FIG. 1, tank 8 is mounted (on support means not shown) in a raised position and comprises an 18 inch diameter, 30 inch long tank of stainless steel. Relief vent 11 is a 1½ inch diameter hole. Supply pipe 10 is of stainless steel and 1¼ inches in diameter and is welded to tank 8. Overflow pipe 9 is of stainless steel and 1½ inches in diameter and is connected to the main supply as is supply pipe 10. Feed pipe 6, threadably secured to tank 8 (not shown) is 1½ inch stainless steel, sch 40 pipe. Valve 12 of stainless steel is a 2 inch ball valve with a Teflon seat, threadably secured to pipe 6. Valve 3 is a ¾-inch stainless steel ball valve with a Teflon seat threadably secured to segments of ¾-inch sch 40 stainless steel pipe 2. Volumetric cylinder 4 of 3 inch diameter Sch 40 stainless steel pipe is 10 inches long with a 700–1000 mil. capacity and with the conical lower portion thereof welded thereto.

In operation, white phosphorus in liquid form is flowed into tank 8 under inert atmosphere 13 which is a blanket of carbon dioxide. Referring to FIGS. 1–8, the same steps are involved excepting that a sealed interconnection is necessary between container 1 and the outlet porton of pipe 6. This is necessary because white phosphorus deleteriously reacts with oxygen.

In summary, my invention cylinder can be used in the precise packaging and the containerizing of any liquid, quasi-liquid or material which function therealike wherein repeditive and reliable results are desired.

It is obvious that other modifications can be made of my invention without departing therefrom, and I desire to be limited only by the scope of the appended claims.

I claim:

1. An apparatus component for controllably regulating substantially liquid material in prescribed quantities for dispensing comprising: a cylinder means with at least one side to receive said material, a material feed means extending into said cylinder means and sealingly affixed thereto; and a return vent means sealingly extending into said cylinder means for controllably regulating the said material; said feed means extends a greater depth into said cylinder means than said vent means and is an offset substantially S-shaped pipe extending within and through a side of said cylinder so that the usable volume of said cylinder is increased.

2. The invention of claim 1 wherein said feed means and said vent means are tubular and said vent tube means is smaller in diameter than said feed means.

3. The invention of claim 2 wherein said cylinder means has a body portion defining said side and a top and bottom portion.

4. The invention of claim 3 wherein said bottom portion has outlet means and has a drain-type surface.

5. The invention of claim 3 wherein said top portion includes vent means sealing means, adjustment means and orifice means for adjusting, holding and providing entry for same into said cylinder means.

6. The invention of claim 5 wherein said adjustment means and said sealing means, comprise screw means and packing for securely surrounding and holding said vent means whereby loosening and tightening said screw means either restrains said vent means from movement or releases same for movement.

7. In a system wherein gravity and the balancing of pressures are beneficially used to quantitatively measure liquid-like materials in conjunction with a feed supply of said materials and vent tube for return flow thereof the improvement comprising: a receiver for measuring said materials immovably connected to said feed supply and adjustably fixed to said vent tube by way of a screw and packing means and wherein said vent tube extends into said receiver means and said feed supply extends to said receiver means by way of a side entrance in said receiver and said feed supply has a portion of substantially an S-shape with a portion of said S extending into said receiver and said feed supply extends a greater distance into said receiver means so that said liquid-like materials are repetitively measured in equal amounts.

8. The invention of claim 7 wherein relatively adjusting the distance said vent tube extends into said receiver quantitatively modifies the liquid materials capacity of said receiver.

* * * * *